US009174071B2

(12) United States Patent
Seman et al.

(10) Patent No.: US 9,174,071 B2
(45) **Date of Patent: *Nov. 3, 2015**

(54) FALL PROTECTION SAFETY HARNESS

(71) Applicant: Honeywell International Inc., Morristown, NJ (US)

(72) Inventors: Michael Seman, Cranberry Township, PA (US); Ross Balquist, Slippery Rock, PA (US); Steve J Sharp, Pleasantville, PA (US); Eric M Manson, Franklin, PA (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/974,312

(22) Filed: Aug. 23, 2013

(65) Prior Publication Data

US 2014/0060969 A1 Mar. 6, 2014

Related U.S. Application Data

(60) Provisional application No. 61/694,759, filed on Aug. 29, 2012, provisional application No. 61/712,243, filed on Oct. 10, 2012.

(51) Int. Cl.
*A62B 35/00* (2006.01)

(52) U.S. Cl.
CPC ..... *A62B 35/0018* (2013.01); *A62B 35/0025* (2013.01)

(58) Field of Classification Search
CPC .... A62B 35/00; A62B 35/04; A62B 35/0006; A62B 35/0018; A62B 35/0025
USPC ..... 182/3
See application file for complete search history.

(56) References Cited

U.S. PATENT DOCUMENTS

| | | | | |
|---|---|---|---|---|
| 3,856,004 | A * | 12/1974 | Cox | 602/19 |
| 5,203,829 | A * | 4/1993 | Fisk et al. | 119/857 |
| 5,531,292 | A | 7/1996 | Bell | |
| 7,490,610 | B2 * | 2/2009 | Franklin | 128/875 |
| 2004/0262080 | A1 * | 12/2004 | Reynolds et al. | 182/3 |
| 2005/0067221 | A1 * | 3/2005 | Wolner et al. | 182/3 |
| 2006/0030632 | A1 * | 2/2006 | Krueger et al. | 521/50 |
| 2007/0209868 | A1 * | 9/2007 | Betcher et al. | 182/3 |
| 2007/0256890 | A1 * | 11/2007 | Petzl | 182/3 |
| 2009/0026012 | A1 * | 1/2009 | Petzl et al. | 182/6 |
| 2009/0127396 | A1 * | 5/2009 | Jordan | 244/151 R |
| 2010/0200329 | A1 * | 8/2010 | Johnson et al. | 182/3 |
| 2010/0300803 | A1 * | 12/2010 | Rinklake | 182/3 |
| 2012/0217090 | A1 * | 8/2012 | Green | 182/8 |
| 2013/0008742 | A1 * | 1/2013 | Schurian et al. | 182/3 |
| 2013/0025968 | A1 * | 1/2013 | Smith et al. | 182/3 |
| 2013/0319793 | A1 * | 12/2013 | Stibilj | 182/3 |

* cited by examiner

*Primary Examiner* — Charles A Fox
*Assistant Examiner* — Kristine Florio
(74) *Attorney, Agent, or Firm* — Craige Thompson; Thompson Patent Law

(57) ABSTRACT

Apparatus and associated methods relate to a fall-protection safety harness having padding structures located at harness pressure points, including dorsal and shoulder regions, the lumbar region, and leg regions. The padding structures may be constructed to provide air-flow parallel to a wearer's skin. Air may flow through wearer-webbing channels created by displacing a webbing via comfort pads. For example, the padding structures may be made by sandwiching foam pads between mesh fabric materials. The foam pads may be captured by the two mesh fabrics using circumferential stitching, for example. Circumferential stitching may permit the foam to retain its uncompressed form which may facilitate webbing displacement. Separate and symmetric pads may be located on both sides of a wearer's spine, both at the lumbar region and at the dorsal region of the back, permitting airflow between pads and along the wearer's spine.

15 Claims, 11 Drawing Sheets

FALL PROTECTION SAFETY HARNESS

CROSS-REFERENCE TO RELATED APPLICATIONS

This application claims priority to the following U.S. Provisional patent applications, the entire disclosures of which are incorporated herein by reference:
61/694,759 Fall-protection Harness Assembly Aug. 29, 2012
61/712,243 Fall-protection Harness Assembly Oct. 10, 2012

TECHNICAL FIELD

Various embodiments relate generally to fall-protection safety devices, specifically webbing harnesses for use in fall-protection.

BACKGROUND

Fall-protection safety harnesses are widely used by workers operating at dangerous heights. These harnesses are also used for recreational purposes such as, for example, rock climbing and spelunking. With the advent of the wind power industry, additional demand for fall-protection safety harnesses has been realized. Construction workers who build such wind turbine towers may need such fall-protection devices. Maintenance workers who climb the wind turbine towers may use such devices. Government inspectors may use fall-protection devices when inspecting wind turbine towers. The need for fall-protection safety harness has increased in recent years due to the promotion of wind turbine towers.

SUMMARY

Apparatus and associated methods relate to a fall-protection safety harness having padding structures located at harness pressure points, including dorsal and shoulder regions, the lumbar region, and leg regions. The padding structures may be constructed to provide air-flow parallel to a wearer's skin. Air may flow through wearer-webbing channels created by displacing a webbing via comfort pads. For example, the padding structures may be made by sandwiching foam pads between mesh fabric materials. The foam pads may be captured by the two mesh fabrics using circumferential stitching, for example. Circumferential stitching may permit the foam to retain its uncompressed form which may facilitate webbing displacement. Separate and symmetric pads may be located on both sides of a wearer's spine, both at the lumbar region and at the dorsal region of the back, permitting airflow between pads and along the wearer's spine.

Various embodiments may achieve one or more advantages. For example, some embodiments may be light in weight. Such light-weight harnesses may be easier to carry. This ease of carry may reduce the energy expenditure of the wearer. The wearer may have more energy for the wearer's work duties. Light-weight harnesses may be easier to don and doff Light-weight harnesses may permit more people to perform a particular work function that requires fall-protection harnesses.

Various embodiments may promote comfort by improving the airflow to and from a wearer. Airflow may be promoted both perpendicular to a wearer's body by used of breathable padding materials. Airflow may be promoted parallel to a wearer's body by topological pad features. Such comfort may encourage the use of fall-protection harnesses. Some embodiments may promote health by preventing chafing due to webbing movement against the skin of a wearer. Various embodiments may permit freedom of motion to a wearer. Minimal pad size and judicious pad locations may permit a wearer full range of motion to perform a task or job.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, an exemplary job where a workman working at great heights on a hot day briefly introduces an exemplary airflow-promoting fall-protection safety harness with reference to FIG. 1. Second, with reference to FIGS. 2-3, the discussion turns to the fit of an exemplary airflow-promoting fall-protection harness to the human form. Then exemplary members of an exemplary comfortable fall-protection safety harness will be described with reference to FIGS. 4-5. Then, with reference to FIGS. 6A-6D, an exemplary lumbar-pad assembly will be described along with exemplary components of such. A description of an exemplary back-pad assembly will follow, with reference to FIGS. 7A-7B. Then an exemplary leg-pad assembly will be described with reference to FIGS. 8A-8B. Exemplary attachment methods will be detailed with reference to FIG. 9. Finally, with reference to FIG. 10, comfortable methods of providing secure back-strap connections will be detailed.

Figure 1:
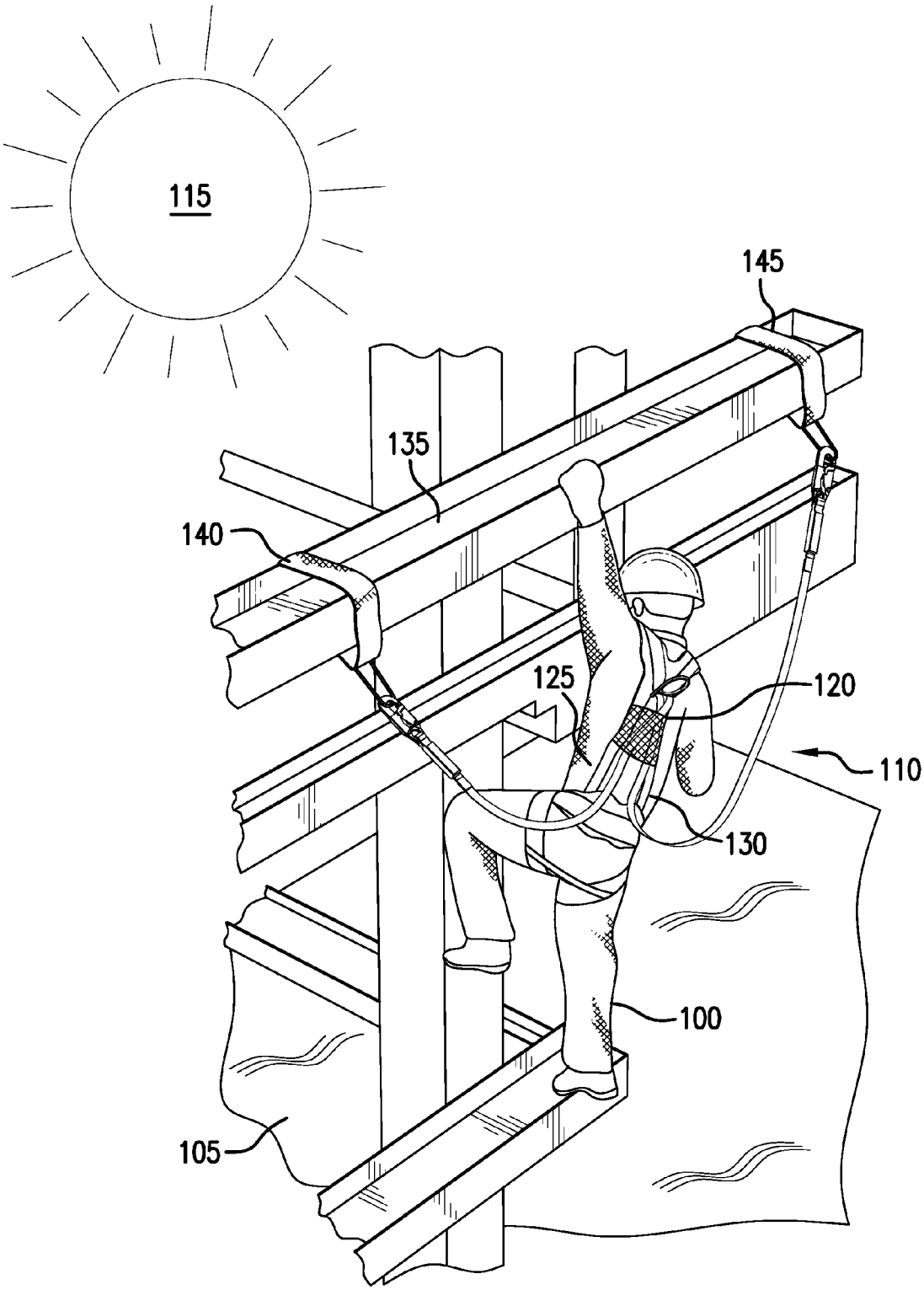
FIG. 1 depicts an exemplary field application of an exemplary airflow-promoting fall-protection safety harness.

FIG. 1 depicts an exemplary field application of an exemplary airflow-promoting fall-protection safety harness. In the FIG. 1 embodiment, a workman 100 is working high above a river 105. The workman is depicted wearing an exemplary airflow-promoting fall-protection safety harness 110. The workman 100 is secured to a beam 135 at two anchor points 140, 145. It may be a hot summer day and a sun 115 may be radiating heat to the worker 100. The worker 100 may be operating high above the river 105 where a wind may provide relief to the heat of the sun 115. Airflow-promoting members may facilitate the airflow both through and around the airflow-promoting fall-protection safety harness. For example, a mesh back strap connector 120 may connect two back straps 125, 130 of the airflow-promoting fall-protection safety harness. The mesh back strap connector 120 may secure the back straps 125, 130 to each other while simultaneously facilitating airflow to the worker.

Figure 2:
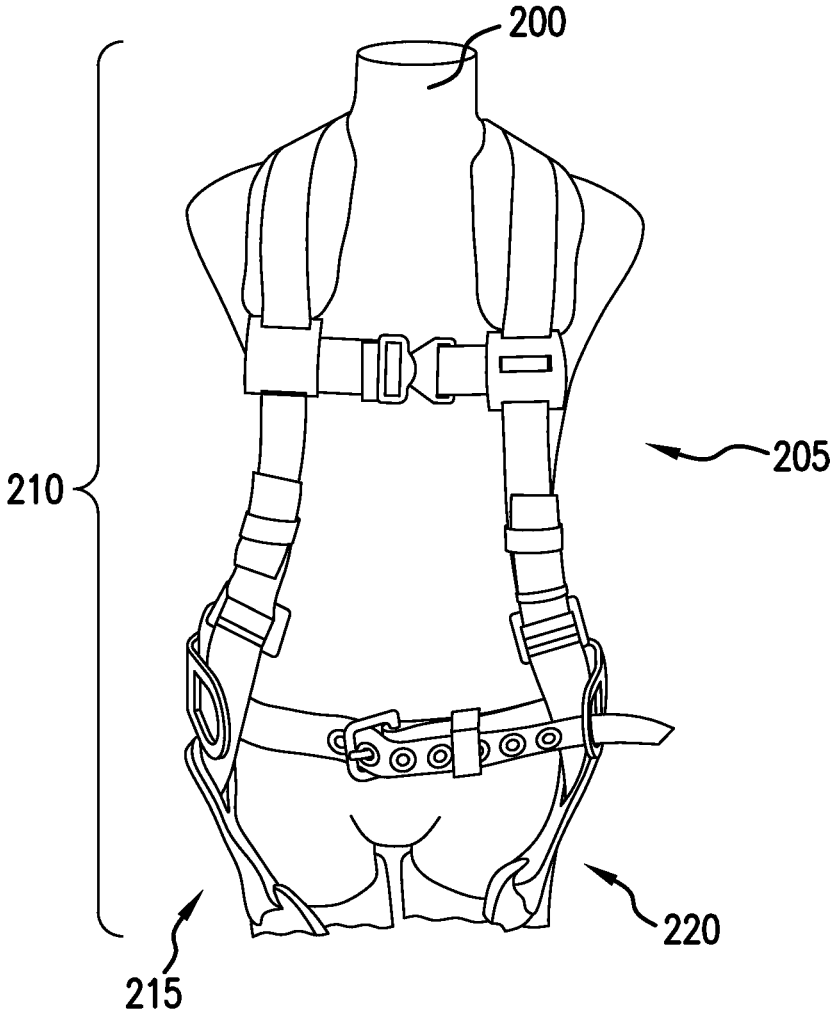
FIG. 2 depicts a front perspective view of an exemplary airflow-promoting fall-protection safety harness worn by a human figure.

FIG. 2 depicts a front perspective view of an exemplary airflow-promoting fall-protection safety harness worn by a human figure. In the FIG. 2 embodiment, a human form 200 is depicted wearing an exemplary airflow-promoting fall-protection safety harness 205. The exemplary airflow-promoting fall-protection safety harness 205 has a webbing 208 that includes a suspender section 210 and two leg-loop sections 215, 220. A belt 225 may delineate border between the suspender section 210 and the two leg sections 215, 220. The suspender section includes two vertically directed frontal sections 230, 235 of the webbing 208. These two vertically directed frontal sections 230, 235 are connected to each other via a horizontal chest member 240. The horizontal chest member 240 is depicted with a clasp 245 which may facilitate donning and doffing of the airflow-promoting fall-protection safety harness 205. Each of the vertically directed frontal sections 230, 235 of the webbing 208 has an adjustment mechanism 250, 255, which may facilitate the proper fitting to the human form 200. The belt 225 of the airflow-promoting fall-protection safety harness 205 may have an adjustable clasp 260, which may facilitate the proper fit to the human form 200. The belt 225 may also couple to side D-rings 265, 270. These side D-rings 265, 270 may permit tools or other safety devices to be connected to the airflow-promoting fall-protection safety harness 205.

The webbing 208 may be made of a safety belt material and may not promote good airflow therethrough. In the FIG. 2 embodiment, shoulder comfort pads 275, 280 may facilitate airflow to a shoulder region of the human form 200. The shoulder comfort pads 275, 280 may be made using materials that facilitate airflow therethrough. Exemplary fabrics may be mesh materials, for example. In some embodiments spacer mesh may be a material used in shoulder comfort pads 275, 280. These shoulder comfort pads 275, 280 may have a foam core, which may displace the webbing 208 from the human form 200. Airflow may pass laterally beneath displaced portions of the webbing 208. Open-cell materials may be used for foam core elements. In some embodiments, reticulated foam may be used to facilitate airflow therethrough. Airflow may pass perpendicular to the body through exposed portions of the shoulder comfort pads 275, 280. In this way, airflow may be facilitated both perpendicularly to and parallel to the human form 200.

Figure 3:
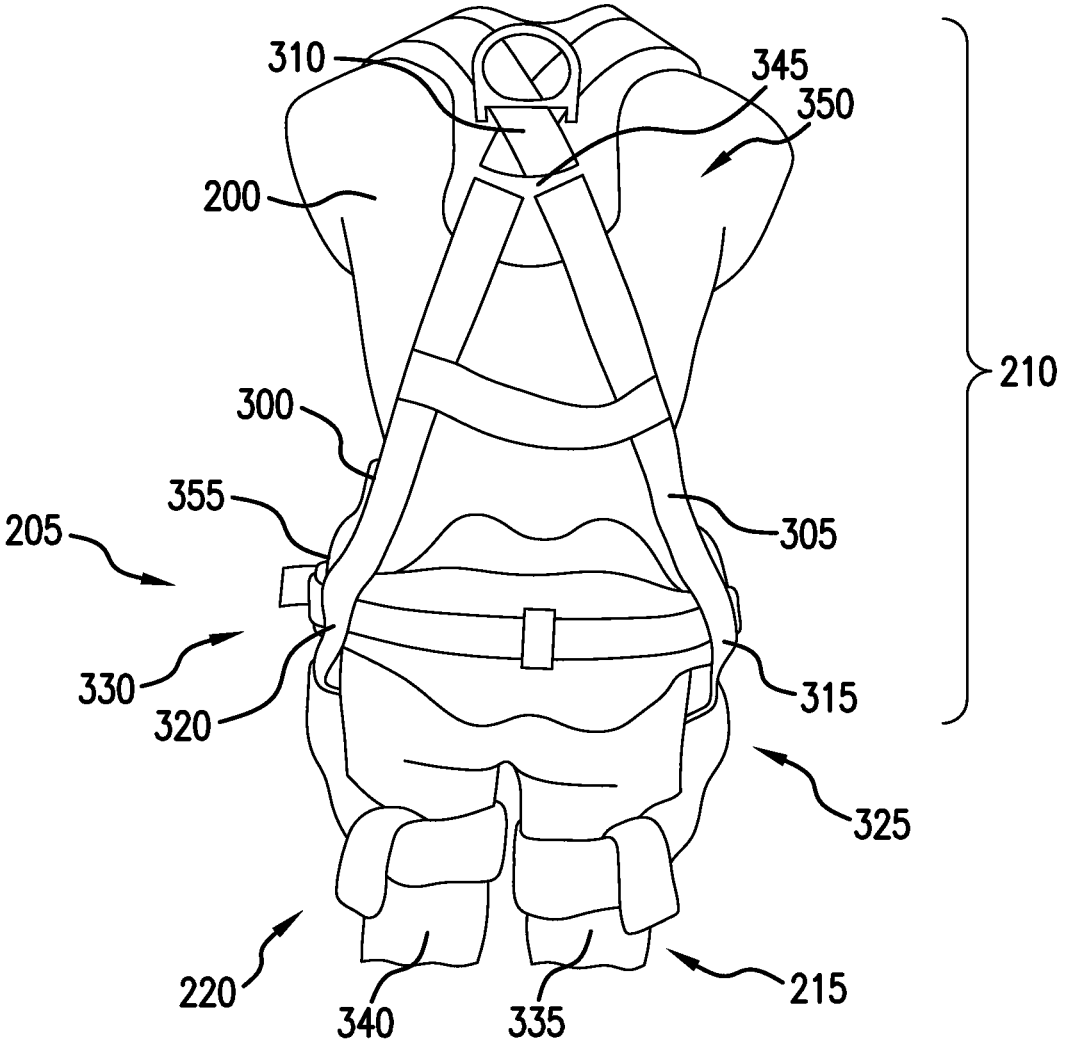
FIG. 3 depicts a rear perspective view of an exemplary airflow-promoting fall-protection safety harness worn by a human figure.

FIG. 3 depicts a rear perspective view of an exemplary airflow-promoting fall-protection safety harness worn by a human figure. In the FIG. 3 embodiment, the human form 200 is depicted wearing the exemplary airflow-promoting fall-protection safety harness 205 depicted in FIG. 2. The exemplary airflow-promoting fall-protection safety harness 205 has the webbing 208 that includes the suspender section 210 and the two leg-loop sections 215, 220. The belt 225 again delineates border between the suspender section 210 and the two leg sections 215, 220. The suspender section includes two crisscrossing back straps 300, 305 of the webbing 208. These two crisscrossing back straps 300, 305 are connected to each other at the criss-cross point 310 and via a horizontal back strap connecting member 315. A D-ring is attached to the webbing 208 at the criss-cross point 310. The leg-loop sections 215, 200 each connect to the crisscrossing rear sections at a leg-suspender connection point 315, 320 near a hip region 325, 330 of the human form 200. Each leg-loop section 215, 220 proceeds from the leg-suspender connection point 315, 320 around the outside of an upper leg 335, 340 of the human form. From there, each leg-loop section 215, 220 circles the upper leg 335. 340 and emerges from between the upper legs 335, 340. After emerging from between the upper legs 335, 340, each leg-loop section 335 circles behind the upper legs 335, 340 and then crisscrosses itself and connects to the vertically directed frontal sections 230, 235.

A dorsal comfort pad 345 is disposed between the criss-cross point 310 of the back straps 300, 305 and a dorsal region 350 of the human form 200. The dorsal comfort pad 345 may facilitate airflow to the dorsal region of the human form 200. The dorsal comfort pad 345 may be made using materials that facilitate airflow therethrough. Exemplary fabrics may be mesh materials, for example. In some embodiments spacer mesh may be a material used in dorsal comfort pads 345. This dorsal comfort pad 345 may have a foam core, which may suspend the webbing 208 from the human form 200. Airflow may pass laterally beneath suspended portions of the webbing 208. Open-cell materials may be used for foam core elements. In some embodiments, reticulated foam may be used to facilitate airflow therethrough. Airflow may pass perpendicular to the body through exposed portions of the dorsal comfort pad 345. In this way, airflow may be facilitated both perpendicularly to and parallel to the human form 200.

A lumbar comfort 355 is disposed between the belt 225 and a lumbar region 360 of the human form 200. The lumbar comfort pad 355 may facilitate airflow to the lumbar region of the human form 200. The lumbar comfort pad 355 may be made using materials that facilitate airflow therethrough. Exemplary fabrics may be mesh materials, for example. In some embodiments spacer mesh may be a material used in dorsal comfort pads 345. In some embodiments, perforated support members may provide some rigidity to the lumbar comfort pad 355. Such perforated materials may provide airflow holes through an otherwise air restricting material. This lumbar comfort pad 355 may have a foam core, which may suspend the webbing 208 from the human form 200. Airflow may pass laterally beneath suspended portions of the webbing 208. Open-cell materials may be used for foam core elements. In some embodiments, reticulated foam may be used to facilitate airflow therethrough. Airflow may pass perpendicular to the body through exposed portions of the dorsal comfort pad 355. In this way, airflow may be facilitated both perpendicularly to and parallel to the human form 200.

Figure 4:
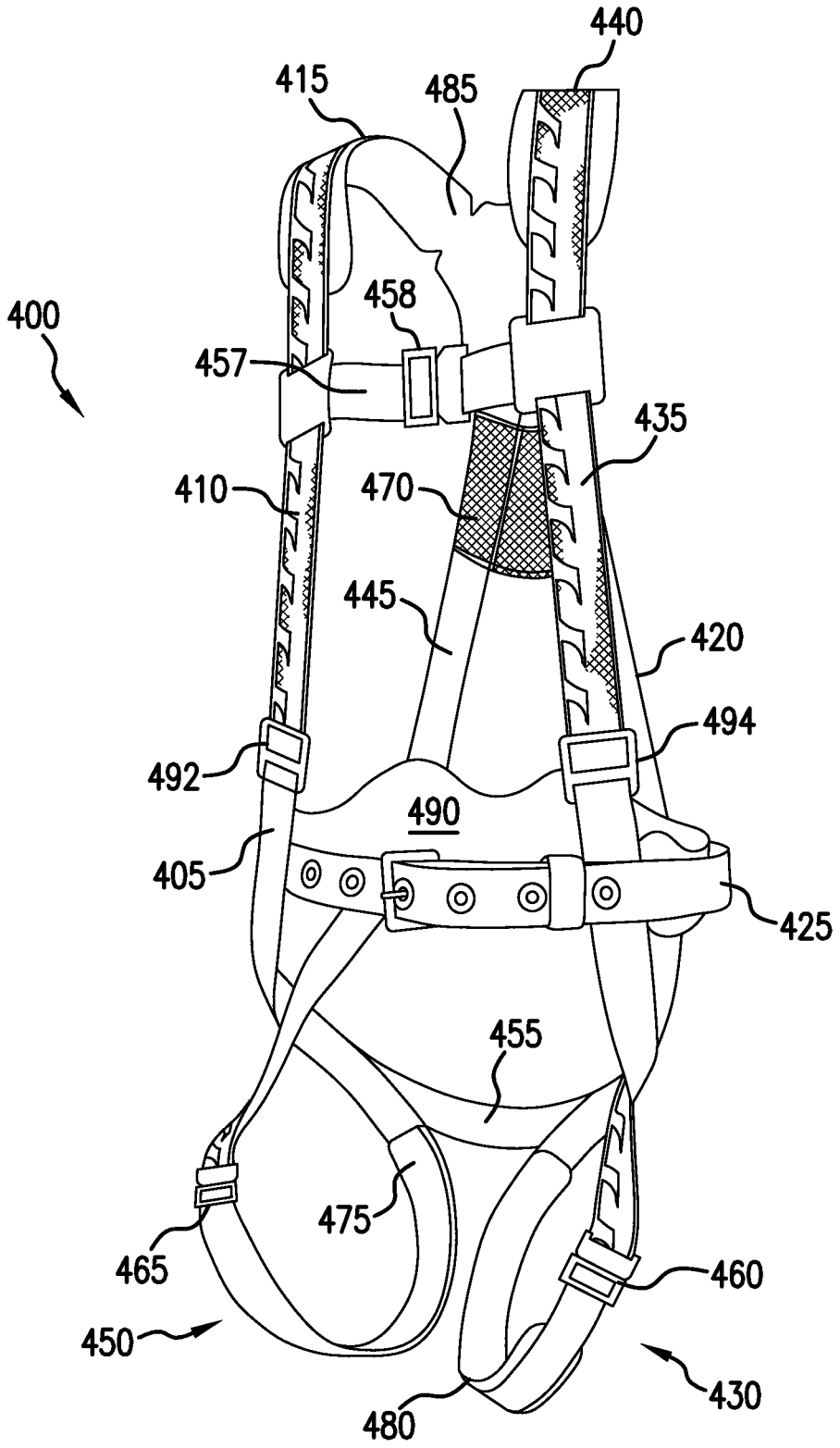
FIG. 4 depicts a front perspective view of an exemplary airflow-promoting fall-protection safety harness in isolation.

FIG. 4 depicts a front perspective view of an exemplary airflow-promoting fall-protection safety harness in isolation. In FIG. 4, an exemplary airflow-promoting fall-protection safety harness 400 is depicted in isolation from a front perspective. Without the human form 200 obscuring a webbing 405, the travel of the webbing 405 can be traced. Ascending vertically from a right vertically-directed frontal member 410, the webbing 405 reaches an apex 415 over a right shoulder region and becomes one of the back strap members 420. Now descending from the right shoulder region, the webbing 405 crosses to the left lumbar region at a belt 425. At the belt 425, the back strap member 420 further descends, becoming a left leg-loop member 430. There, the webbing 405 continues descending around and outside an upper left-leg region and then continuing around a front of the upper left-leg region, and between the upper left-leg region and an upper right-leg region. After passing between the upper leg regions, the left leg-loop crisscrosses itself at a hip region and becomes a left vertically directed frontal member 435 at the belt 425. Ascending vertically from the left vertically-directed frontal member 435, the webbing 405 reaches another apex 440 over a left shoulder region and becomes another of the back strap members 445. Now descending from the left shoulder region, the webbing 405 crosses over the back strap member 420 to the right lumbar region at the belt 425. At the belt 425, the back strap member 445 further descends, becoming a right leg-loop member 450. There, the webbing 405 continues descending around and outside an upper right-leg region and then continuing around a front of the upper right-leg region, and between the upper right-leg region and the upper left-leg. Region. After passing between the upper leg regions, the right leg-loop crisscrosses itself at a hip region and becomes again the right vertically directed frontal member 420 at the belt 425.

Various embodiments may have additional webbing members. In the FIG. 4 embodiment, a leg-loop connecting member 455 is depicted. The leg-loops 430, 450 each have an adjustment mechanism 460, 465. Each leg-loop adjustment mechanism 460, 465 may facilitate the proper fitting of the airflow-promoting fall-protection safety harness 400 to the human form 200. Also depicted is a horizontal chest strap 457 connecting to the vertically-directed frontal members 410, 435. The horizontal chest strap 457 has a connection buckle 458 which may open and close to facilitate donning and doffing of the air-flow promoting fall-protection safety harness 400. Each of the vertically-directed frontal members 410, 425 has an adjustment mechanism 492, 494. Various comfort elements are depicted in FIG. 4 as well. For example, a mesh back strap connecting member 470 is depicted. Such a back strap connecting member may secure the backstops 420, 445 so that during a fall event, the back straps 420, 445 may not separate permitting a wearer to fall through the back straps 420, 445. Each leg-loop member 430, 450 is depicted having a leg-pad assembly 475, 480. A back-pad assembly 485 is depicted as providing both shoulder comfort and dorsal region comfort. A lumbar-pad assembly 490 is depicted as being attached to the belt 425 in a lumbar region.

Figure 5:
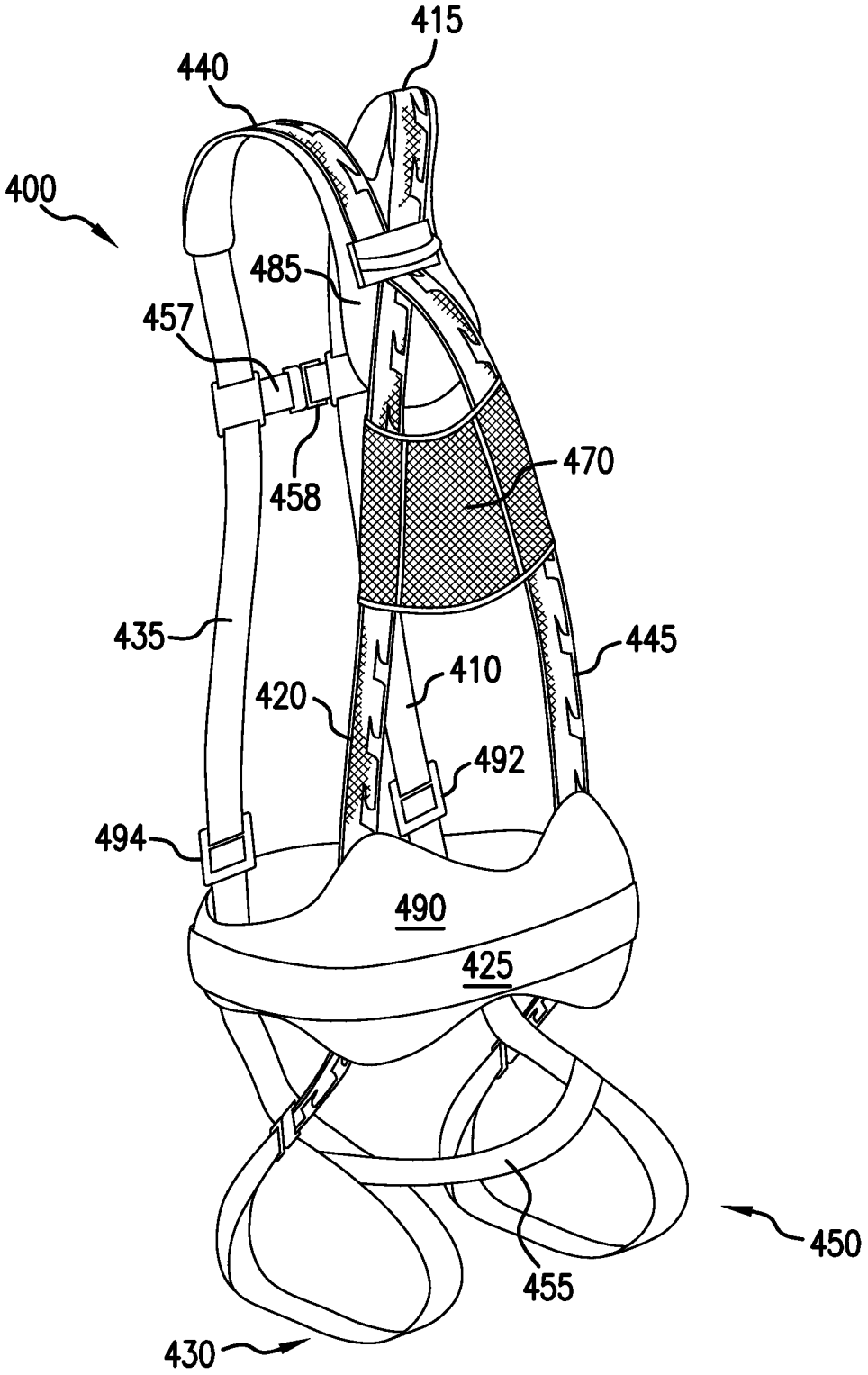
FIG. 5 depicts a rear perspective view of an exemplary airflow-promoting fall-protection safety harness in isolation.

FIG. 5 depicts a rear perspective view of an exemplary airflow-promoting fall-protection safety harness in isolation. In FIG. 5, the exemplary airflow-promoting fall-protection safety harness 400 of FIG. 4 is depicted in isolation from a rear perspective. Again the webbing 405 can be traced without a human form 200 obstructing the view. This perspective view clearly depicts the mesh back strap connector 470. Also clearly seen in this perspective view is the lumbar-pad assembly disposed between the belt and the human form 200.

Figure 6A:
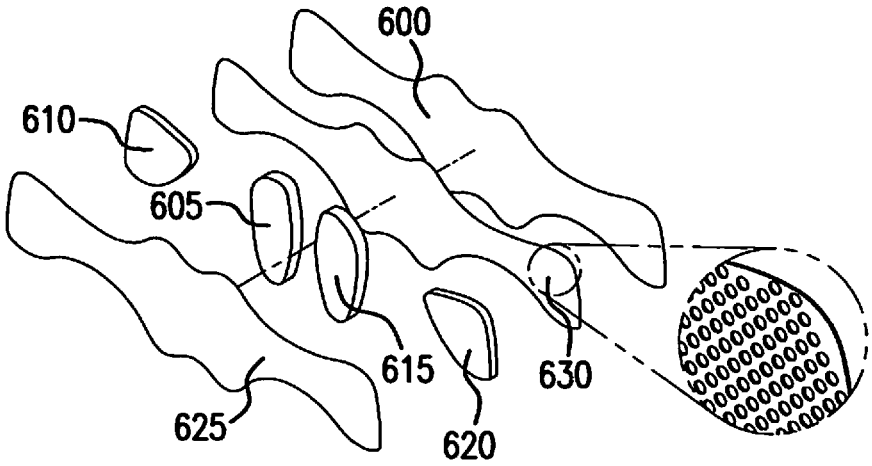
FIG. 6A depicts a perspective exploded view of an exemplary lumbar-pad assembly.

FIG. 6A depicts a perspective exploded view of an exemplary lumbar pad assembly. In the FIG. 6A embodiment, exemplary components of a lumbar-pad assembly are depicted. In the depicted embodiment, a belt-contacting piece 600 may be made of a breathable mesh material. In some embodiments, spacer mesh materials may be used. A similarly cut perforated support structure 630 may provide the lumbar pad assembly form. The perforated support structure 630 may be made of a flexible plastic, for example. Perforations may promote airflow through the perforated support structure 630. Four comfort pads 605, 610, 615, 620 may provide cushion to a wearer. The comfort pads 605, 610, 615, 620 may be of a soft foam material, for example. To promote airflow, open cell foams may be used in various embodiments. Reticulated foam may be used in some embodiments. The wearer-contacting material 625 may also be of a breathable material. Mesh materials may be used for the wearer-contacting layer 625. For example spacer mesh may be used for the wearer-contacting layer. Airflow through the lumbar-pad assembly may be promoted by the use of materials that promote airflow.

Figure 6B:
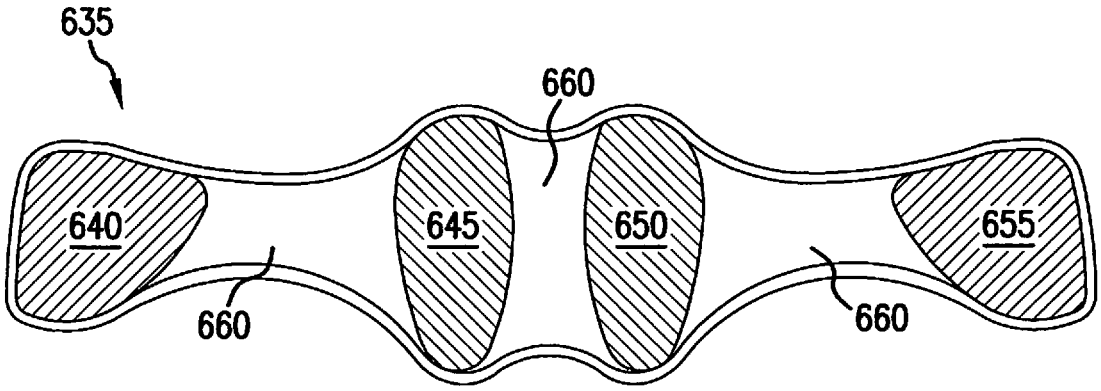
FIG. 6B depicts a plan view of an exemplary lumbar-pad assembly.

FIG. 6B depicts a plan view of an exemplary lumbar-pad assembly. In FIG. 6B, an exemplary lumbar-pad assembly 635 includes four lumbar comfort pads 640, 645, 650, 655. The comfort pads 640, 645, 650, 655 are shown encapsulated in a mesh material 625. The exemplary comfort pads 640, 645, 650, 655 have been encapsulated by stitching that circumscribes each comfort pad 640, 645, 650, 655. Circumferential stitching may permit the comfort pads to assume their uncompressed natural volumes. Uncompressed comfort pads 640, 645, 650, 655 may project from a base 660 of the lumbar-pad assembly 635. Uncompressed comfort pads 640, 645, 650, 655 may project in the direction of the wearer, for example. As shown in FIG. 6A, the perforated support member 630 is on a belt side of the lumbar-pad assembly 635. The direction of projection of the uncompressed comfort pads 640, 645, 650, 655 may be facilitated by the perforated support member's relative rigidity with respect to the mesh materials.

Figure 6C:
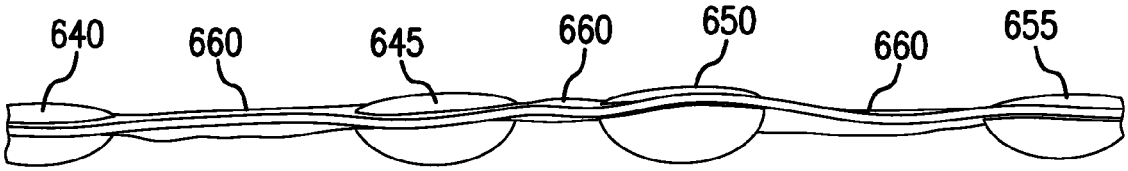
FIG. 6C depicts a side elevation view of an exemplary lumbar-pad assembly.

FIG. 6C depicts a side elevation view of an exemplary lumbar-pad assembly. Here, the relative projecting elevations of the lumbar comfort pads 640, 645, 650, 655 can be seen. In this exemplary embodiment, the two outside lumbar comfort pads 640, 655 may contact a wearer at the right and left hip of the lumbar region, while the two inside lumbar comfort pads 645, 650 may contact the wearer on either side of the spinal column at the lumbar region of a wearer's back. The projecting elevations may facilitate airflow parallel to the wearer's body. For example, the two inside lumbar comfort pads 645, 650 may permit air to flow between the two comfort pads 645, 650 and vertically in the small of the back of a wearer. Airflow may also be promoted between the inside comfort pads 645, 650 and the outside comfort pads 640, 655. Airflow may be promoted around each isolated comfort pad 640, 645, 650, 655 as well. Airflow may also enter each comfort pad 640, 645, 650, 655 parallel to a wearer's body and then flow perpendicular to the wearer as the materials used in the lumbar-pad assembly promote airflow. In this way, airflow may be facilitated both perpendicularly to and parallel to the human form 200.

Figure 6D:
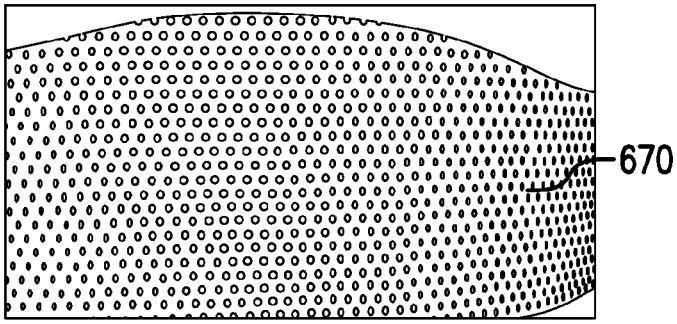
FIG. 6D depicts a close-up view of an exemplary perforation support member.
Figure 7A:
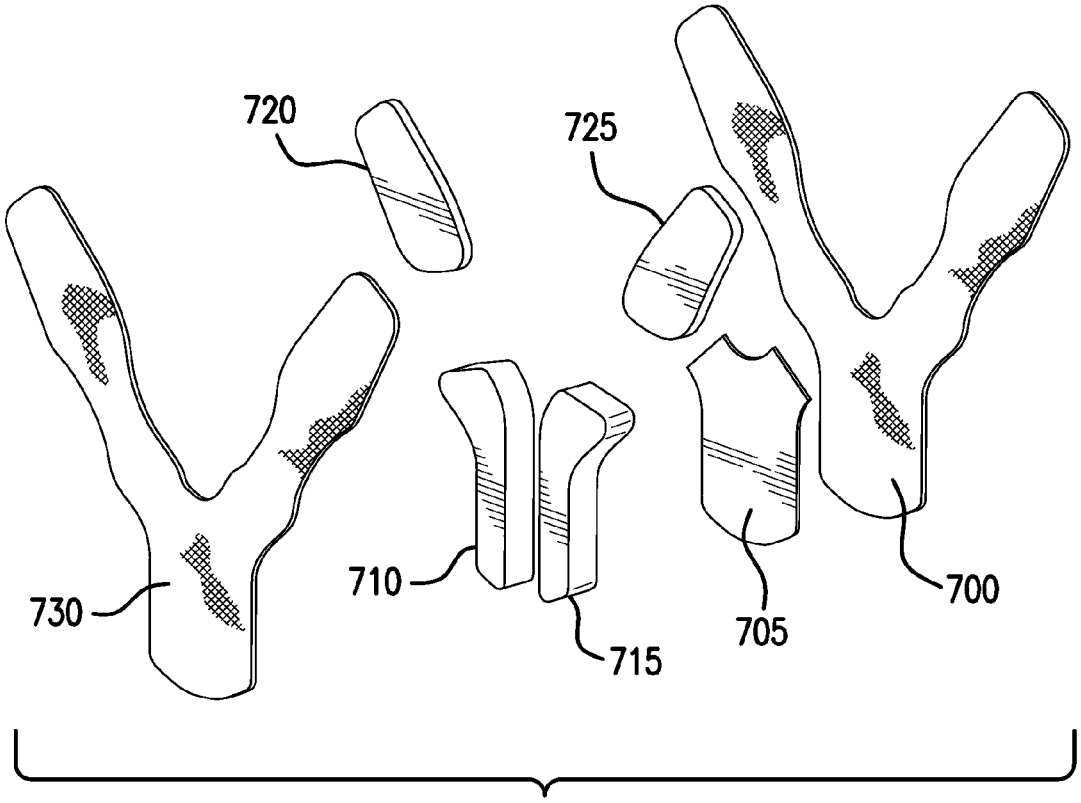
FIG. 7A depicts a perspective exploded view of an exemplary back-pad assembly.

FIG. 6D depicts a close-up view of an exemplary perforation support member. In this figure, an exemplary perforated support member 670 is depicted. In this embodiment, a honeycomb pattern of perforation is used. Various perforation patterns may be used to further promote airflow. For example, the relative area of hole to plastic may be increased by using larger holes. Or, conversely, if more rigidity is required, smaller holes may be used. Various materials may be used for the FIG. 7A depicts a perspective exploded view of an exemplary back-pad assembly. In the FIG. 7A embodiment, exemplary components of a back-pad assembly are depicted. In the depicted embodiment, a webbing-contacting piece 700 may be made of a breathable mesh material. In some embodiments, spacer mesh materials may be used. A support structure 705 may provide the back-pad assembly form. The perforated support structure 705 may be made of a flexible plastic, for example. Perforations may promote airflow through the perforated support structure 705. Four comfort pads 710, 715, 720, 725 may provide cushion to a wearer. The comfort pads 710, 715, 720, 725 may be of a soft foam material, for example. To promote airflow, open cell foams may be used in various embodiments. Reticulated foam may be used in some embodiments. The wearer-contacting material 730 may also be of a breathable material. Mesh materials may be used for the wearer-contacting layer 730. For example spacer mesh may be used for the wearer-contacting layer. Airflow through the lumbar-pad assembly may be promoted by the use of materials that promote airflow.

Figure 7B:
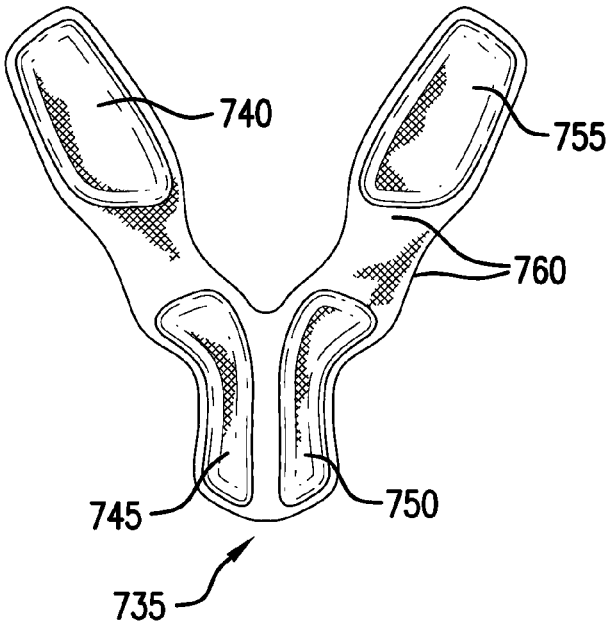
FIG. 7B depicts a top perspective view of an exemplary back-pad assembly.

FIG. 7B depicts a top perspective view of an exemplary back-pad assembly. In FIG. 7B, an exemplary lumbar-pad assembly 735 includes four lumbar comfort pads 740, 745, 750, 755. The comfort 740, 745, 750, 755 are shown encapsulated in a mesh material 705. The exemplary comfort pads 740, 745, 750, 755 have been encapsulated by stitching that circumscribes each comfort pad 740, 745, 750, 755. Circumferential stitching may permit the comfort pads to assume their uncompressed natural volumes. Uncompressed comfort pads 740, 745, 750, 755 may project from a base 760 of the back-pad assembly 735. Uncompressed comfort pads 740, 745, 750, 755 may project in the direction of the wearer, for example. As shown in FIG. 6A, the perforated support member 705 is on a webbing side of the back-pad assembly 735. The direction of projection of the uncompressed comfort pads 740, 745, 750, 755 may be facilitated by the perforated support member's relative rigidity with respect to the mesh materials.

In this exemplary embodiment, the two outside back comfort pads 740, 755 may contact a wearer at the shoulders, while the two inside back comfort pads 745, 750 may contact the wearer on either side of the spinal column at the dorsal region of the wearer's back. The projecting elevations may facilitate airflow parallel to the wearer's body. For example, the two inside back comfort pads 745, 750 may permit air to flow between the two comfort pads 745, 750 and vertically in the small of the back of a wearer. Airflow may also be promoted between the inside comfort pads 745, 750 and the shoulder comfort pads 740, 755. Airflow may be promoted around each isolated comfort pad 740, 745, 750, 755 as well. Airflow may also enter each comfort pad 740, 745, 750, 755 parallel to a wearer's body and then flow perpendicular to the wearer as the materials used in the lumbar-pad assembly promote airflow. In this way, airflow may be facilitated both perpendicularly to and parallel to the human form 200.

Figure 8A:
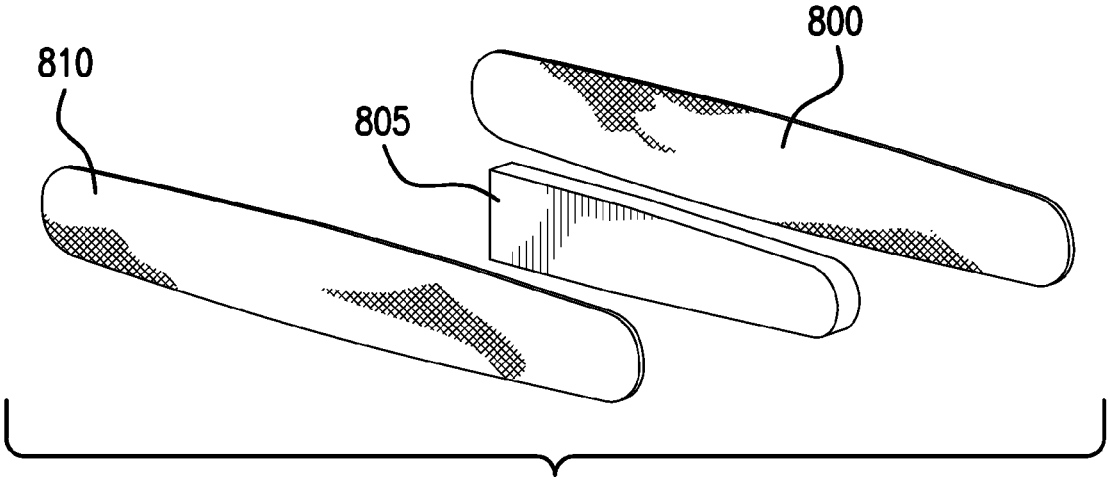
FIG. 8A depicts a perspective exploded view of an exemplary leg-pad assembly.

FIG. 8A depicts a perspective exploded view of an exemplary leg-pad assembly. In the FIG. 8A embodiment, exemplary components of a leg-pad assembly are depicted. In the depicted embodiment, a webbing-contacting piece 800 may be made of a breathable mesh material. A comfort pad 805 may be sandwiched between the webbing-contacting piece 800 and a wearer-contacting piece 810 of breathable material. In this embodiment, the comfort pad 805 only extends for a portion of the leg-pad assembly. In some embodiments two or more comfort pads may be used in a leg-pad assembly.

Figure 8B:
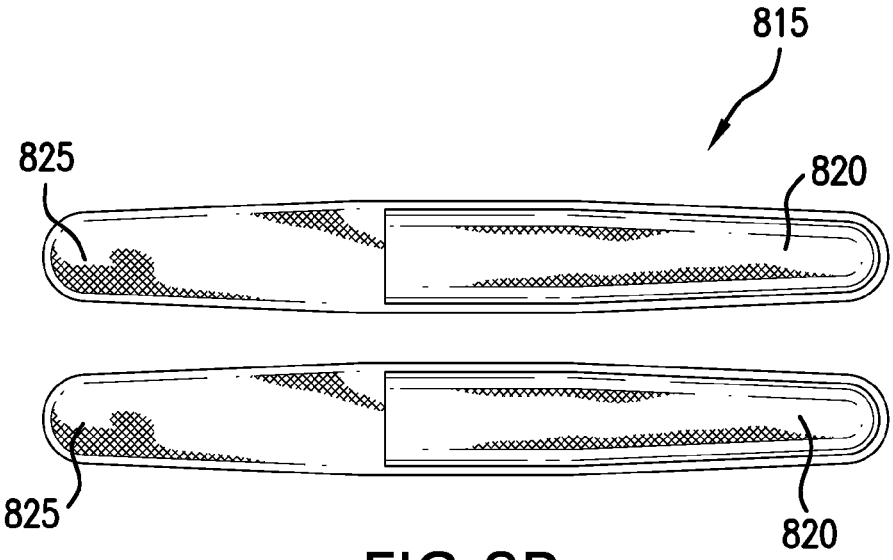
FIG. 8B depicts a top perspective view of an exemplary leg-pad assembly.

FIG. 8B depicts a top perspective view of an exemplary leg-pad assembly. In FIG. 8B an exemplary leg-pad assembly 815 is depicted. In the depicted embodiment, a comfort pad 820 occupies a portion of the leg-pad assembly 810. A base portion 825 of the leg-pad assembly 815 has no foam pad within. In some embodiments such a leg-pad assembly may provide different amounts of foam in different leg locations. Such an embodiment, for example, may provide more foam in a pressure point location of a wearer. A webbing may chafe a wearer, and so the base region 825 of the leg-pad assembly 815 may be disposed between the webbing and the wearer to prevent such chafing. Such foamless padding may also promote airflow to these regions of a wearer's legs.

Figure 9:
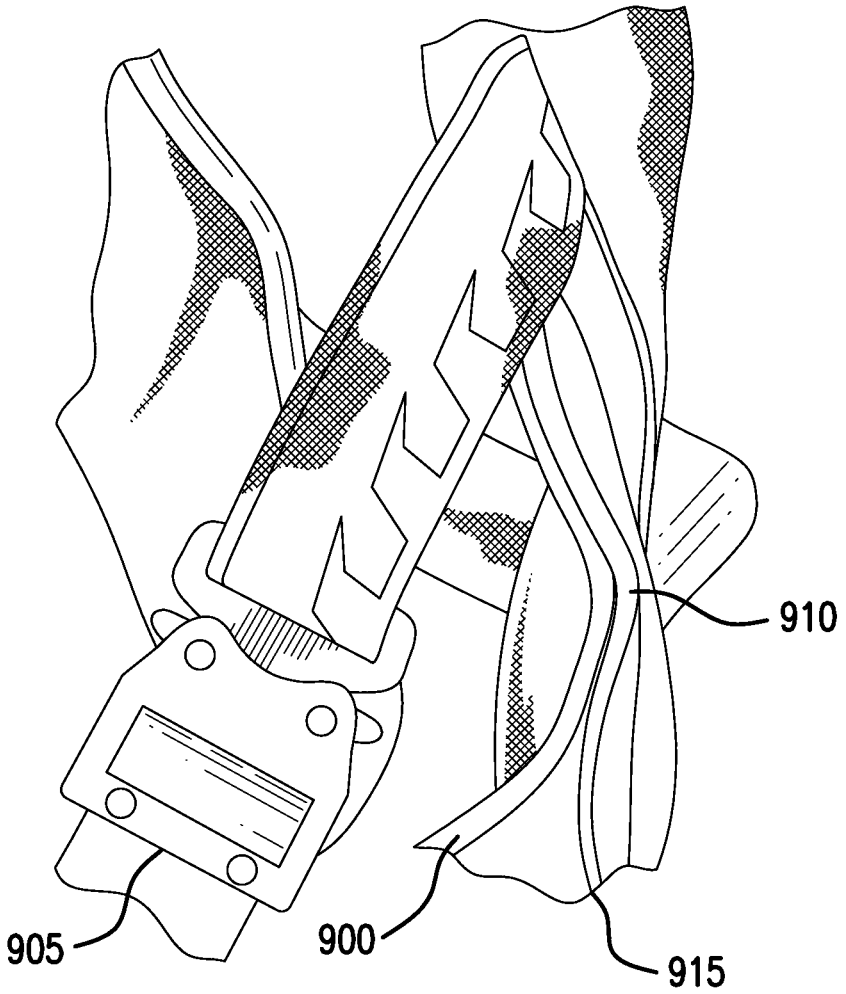
FIG. 9 depicts a perspective view showing an exemplary attachment method of an exemplary leg-pad assembly to a webbing.

FIG. 9 depicts a perspective view showing an exemplary attachment method of an exemplary leg-pad assembly to a webbing. In FIG. 9, a close-up of a leg-pad assembly 900 is shown attached to a webbing 905. The leg-pad assembly 900 is attached at discrete locations 910, 915. In some embodiments, sew patterns that are substantially transverse to the direction of the webbing may be used. Such transverse sew patterns may permit air to flow between the leg-pad assemblies and the webbing. Transverse sew patterns may also be used to attach the lumbar-pad assembly to the belt. In some embodiments, substantially transverse sew patterns may be used to attach a back-pad assembly to a webbing.

Figure 10:
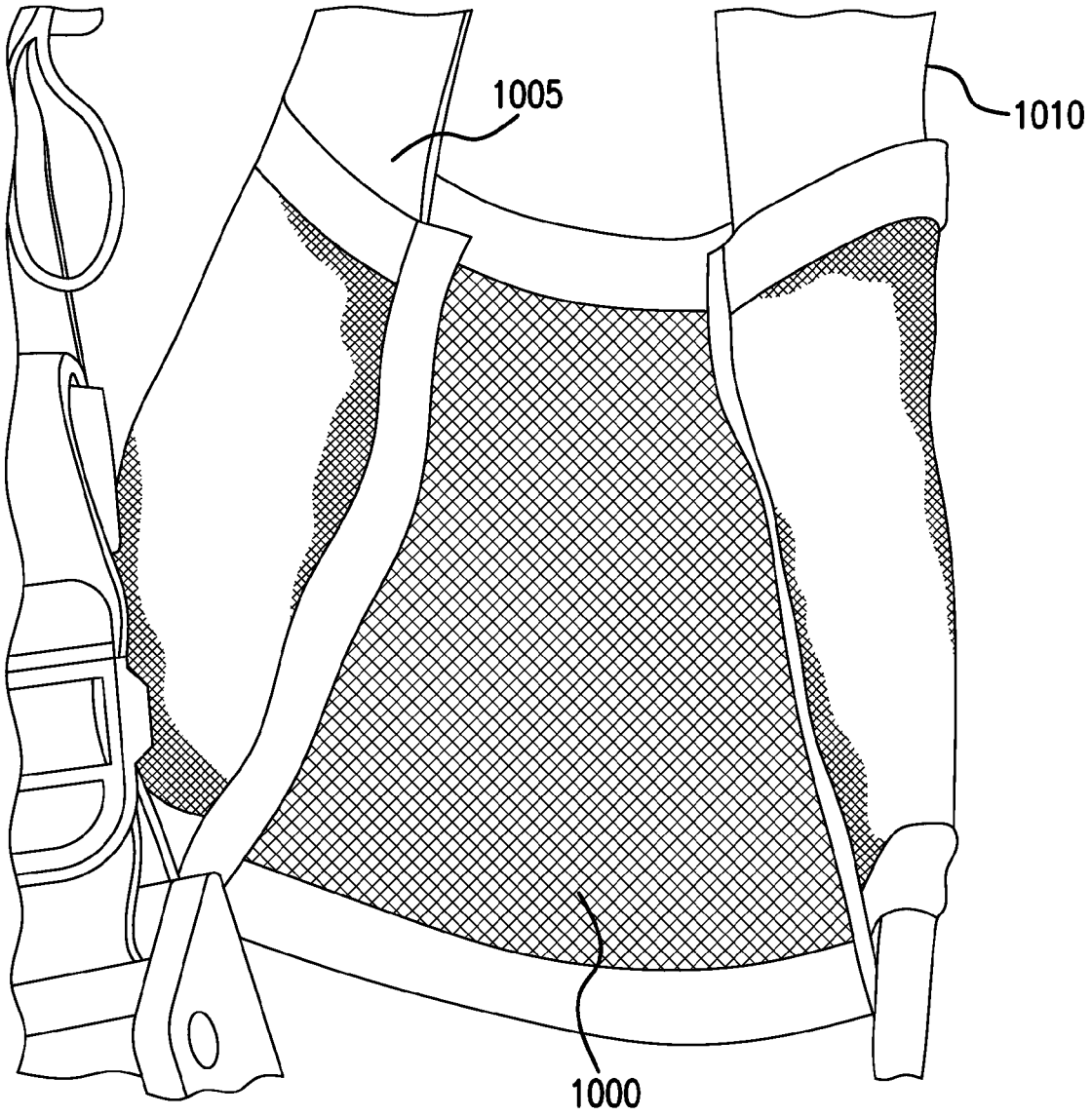
FIG. 10 depicts an exemplary mesh back strap connector.

FIG. 10 depicts an exemplary mesh back strap connector. In this figure, an exemplary mesh back strap connector 1000 is shown attached to two back straps 1005, 1010. The mesh back strap connector 1000 may prevent the back straps 1005, 1010 from separating one from another during a fall event. Preventing the back straps from separating may in turn prevent a wearer from falling through the back straps. The mesh material used in the back strap connector may facilitate airflow between the wearer and the atmosphere. Such a mesh material may thereby improve the comfort of the wearer.

Although various embodiments have been described with reference to the Figures, other embodiments are possible. For example, in some embodiments, the comfort pads are sized to be only slightly larger than the webbing. In this way, airflow may be minimally restricted. In some embodiments, various sizes and dimensions of foam pieces may be used. In some embodiments, multiple foam thicknesses may be used. For example thick pieces of foam may be used for certain pressure points, while thin foam may be used to other pressure points. For example, principal pressure points during a fall event may have thick comfort pads, while lessor pressure points may have thin comfort pads.

In some embodiments, comfort pads may be sewn to the support members to prevent bunching. In various embodiments, the comfort pads may be isolated. For example, instead of a back-pad assembly, discrete back and shoulder pads may be affixed to the webbing. In some embodiments, the circumferential sewing of the foam pads may be performed just within the actual pad's circumference. In this way, the interior of the foam pad may assume its natural volume, while only the edge is compressed while being firmly attached to the pad assembly. This may prevent bunching of the pads while substantially maintaining pad volumes.

An exemplary fall-protection safety harness may include a webbing configured to be worn by a wearer, the webbing comprising a suspender section. Some embodiments may include a right leg-loop strap attached to a right side of the suspender section. Some embodiments may include a left leg-loop strap attached to a left side of the suspender section. In various embodiments, the suspender section may have two suspender straps coupled to each other at a crisscross point proximate a dorsal region of a wearer's back when worn. In an exemplary embodiment, each strap may have an adjustment mechanism, each of the right and left leg-loop sections having an independent adjustment mechanism;

Some embodiments may include a waist strap coupled to the webbing, wherein the suspender section may attach to both the right and the left leg-loop straps at approximately waist strap connection locations. In some embodiments, a Y-shaped back-pad assembly may couple to the webbing be disposed between the suspender section and the dorsal region and a wearer's shoulders when worn. The Y-shaped back-pad assembly may include a wearer-contacting layer of mesh material, a plurality of foam pads, and a webbing-contacting layer of mesh material. Each one of the plurality of foam pads may be captured by the wearer-contacting layer and the webbing-contacting layer with stitching circumscribing the pad, wherein an air channel is formed between symmetric foam pads on either side of a small of a back near the dorsal region. Some embodiments may include two leg-pad assemblies a right leg-pad assembly coupled to the right leg-loop strap and a left leg-pad assembly coupled to the left leg-loop strap. Each of the two leg-pad may include a wearer-contacting layer of mesh material, one or more foam pads, and a webbing-contacting layer of mesh material. Each of the one or more foam pads may be captured by the wearer-contacting layer and the webbing-contacting layer with stitching circumscribing the pad, wherein each of the two leg-pad assemblies is disposed between the webbing and one of a wearer's upper legs when worn; and, Some embodiments may include a lumbar-pad assembly coupled to the waist strap and disposed between the waist strap and a wearer's lumbar region when worn. The lumbar-pad assembly may include a perforated flexible support structure sandwiched between a wearer-contacting layer of mesh material and a waist-strap contacting mesh material. The lumbar-pad assembly may include a plurality of foam pads positioned between the wearer-contacting layer and the perforated flexible support structure. Each one of the plurality of foam pads may be captured by the wearer-contacting layer and the perforated flexible support structure with stitching circumscribing the pad, wherein an air channel is formed between symmetric pads on either side of the small of the back near a lumbar region of the wearer when worn.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. A fall-protection safety harness comprising:

a webbing configured to be worn by a wearer, the webbing comprising a suspender section, a right leg-loop strap attached to a right side of the suspender section and a left leg-loop strap attached to a left side of the suspender section, the suspender section having two suspender straps coupled to each other at a crisscross point proximate a dorsal region of a wearer's back when worn, each strap having an adjustment mechanism, each of the right and left leg-loop sections having an independent adjustment mechanism;

a waist strap coupled to the webbing, wherein the suspender section attaches to both the right and the left leg-loop straps at approximately waist strap connection locations;

a Y-shaped back-pad assembly sewn to the webbing and disposed between the suspender section and the dorsal region and a wearer's shoulders when worn, the Y-shaped back-pad assembly comprising a wearer-contacting layer of mesh material, a plurality of foam pads, and a webbing-contacting layer of mesh material, each one of the plurality of foam pads being captured by the wearer-contacting layer and the webbing-contacting layer with stitching circumscribing the pad, wherein an air channel providing airflow substantially parallel to the wearer's skin is formed between each pair of adjacent foam pads of the Y-shaped back-pad assembly;

two leg-pad assemblies a right leg-pad assembly fixedly coupled to the right leg-loop strap and a left leg-pad assembly fixedly coupled to the left leg-loop strap, each of the two leg-pad assemblies comprising a wearer-contacting layer of mesh material, one or more foam pads, and a webbing-contacting layer of mesh material, each of the one or more foam pads being captured by the wearer-contacting layer and the webbing-contacting layer with stitching circumscribing the pad, wherein each of the two leg-pad assemblies is disposed between the webbing and one of a wearer's upper legs when worn; and, a lumbar-pad assembly sewn to the waist strap and disposed between the waist strap and a wearer's lumbar region when worn, the lumbar-pad assembly comprising a perforated flexible support structure sandwiched between a wearer-contacting layer of mesh material and a waist-strap contacting mesh material, the lumbar-pad assembly further comprising a plurality of pairs of adjacent foam pads positioned between the wearer-contacting layer and the perforated flexible support structure, each one of the foam pads of the plurality of pairs of foam pads being captured by the wearer-contacting layer and the perforated flexible support structure with stitching circumscribing the pad, wherein, when the lumbar pad assembly is worn by the wearer, a plurality of air channels providing airflow directly adjacent and substantially parallel to the wearer's skin are formed between the adjacent foam pads in each pair of the plurality of pairs of adjacent foam pads of the lumbar-pad assembly.

2. The fall-protection safety harness of claim 1, further comprising a horizontal back strap connector attached to the two suspender straps at the wearer's back when worn.

3. The fall-protection safety harness of claim 1, further comprising a D-ring coupled to the suspender section, wherein the two suspender straps thread through a webbing aperture of the D-ring at approximately the crisscross point.

4. The fall-protection safety harness of claim 1, further comprising two side D-rings, a right side D-ring attached to the waist strap near a wearer's right hip region when worn and a left side D-ring attached to the waist strap near a wearer's left hip region when worn.

5. The fall-protection safety harness of claim 4, further comprising a belt coupled to the two side D-rings.

6. A fall-protection safety harness comprising:

a webbing configured to be worn by a wearer, the webbing comprising a suspender section, a right leg-loop strap attached to a right side of the suspender section and a left leg-loop strap attached to a left side of the suspender section, the suspender section having two suspender straps coupled to each other at a crisscross point proximate a dorsal region of a wearer's back when worn, each strap having an adjustment mechanism, each of the right and left leg-loop sections having an independent adjustment mechanism;

a waist strap coupled to the webbing, wherein the suspender section attaches to both the right and the left leg-loop straps at approximately waist strap connection locations;

a plurality of suspender comfort pads sewn to the webbing and disposed between the suspender section of the webbing and a wearer's dorsal region and shoulders when worn, each one of the plurality of suspender comfort pads comprising mesh fabric and foam, wherein an air channel providing airflow substantially parallel to a wearer's skin is formed between each adjacent pair of suspender comfort pads;

a right-leg comfort pad coupled the right leg-loop strap and disposed between the right leg-loop strap and a wearer's right upper leg when worn, the right-leg comfort pad comprising mesh fabric and foam;

a left-leg comfort pad coupled the left leg-loop strap and disposed between the left leg-loop strap and a wearer's left upper leg when worn, the left-leg comfort pad comprising mesh fabric and foam; and, a lumbar-pad assembly sewn to the waist strap and disposed between the waist strap and a wearer's lumbar region when worn, the lumbar-pad assembly comprising a perforated flexible support structure sandwiched between a wearer-contacting layer of mesh material and a waist-strap contacting mesh material, the lumbar-pad assembly further comprising a plurality of pairs of adjacent foam pads positioned between the wearer-contacting layer and the perforated flexible support structure, each one of the foam pads of the plurality of pairs of foam pads being captured by the wearer-contacting layer and the perforated flexible support structure with stitching circumscribing the pad, wherein, when the lumbar pad assembly is worn by the wearer, a plurality of air channels providing airflow directly adjacent and substantially parallel to the wearer's skin are formed between the adjacent foam pads in each pair of the plurality of pairs of adjacent foam pads of the lumbar-pad assembly.

7. The fall-protection safety harness of claim 6, further comprising a horizontal back strap connector attached to the two suspender straps at the wearer's back when worn.

8. The fall-protection safety harness of claim 6, further comprising a D-ring coupled to the suspender section, wherein the two suspender straps thread through a webbing aperture of the D-ring at approximately the crisscross point.

9. The fall-protection safety harness of claim 6, further comprising two side D-rings, a right side D-ring attached to the waist strap near a wearer's right hip region when worn and a left side D-ring attached to the waist strap near a wearer's left hip region when worn.

10. The fall-protection safety harness of claim 9, further comprising a belt coupled to the two side D-rings.

11. The fall-protection safety harness of claim 6, wherein each of the plurality of suspender comfort pads are encapsulated by circumferential stitching.

12. The fall-protection safety harness of claim 6, wherein the mesh fabric comprises spacer mesh material.

13. The fall-protection safety harness of claim 6, wherein each of the plurality of lumbar comfort pads are encapsulated by circumferential stitching.

14. The fall-protection safety harness of claim 13, further comprising a perforated flexible support structure having a perforation pattern of holes in a honeycomb arrangement, the perforated flexible support structure disposed between the waist strap and the wearer's lumbar region, when worn.

15. The fall-protection safety harness of claim 6, wherein the each one of right-leg and left-leg two comfort leg-pads is attached to the webbing with sew patterns that are transverse to the webbing direction to permit air to flow between the webbing and the leg-pads.

* * * * *